US005085607A

United States Patent [19]

Shibahashi et al.

[11] Patent Number: 5,085,607

[45] Date of Patent: Feb. 4, 1992

[54] TOY THAT STABLY EXHIBITS DIFFERENT COLORS WITH INDICATOR FOR PROPER TEMPERATURE APPLICATION

[75] Inventors: Yutaka Shibahashi, Aichi; Tsutomu Kito, Gifu; Norikazu Nakasuji; Hiroshi Inagaki, both of Aichi, all of Japan

[73] Assignee: The Pilot Ink Co., Ltd., Nagoya, Japan

[21] Appl. No.: 596,316

[22] Filed: Oct. 12, 1990

[30] Foreign Application Priority Data

Oct. 14, 1989 [JP] Japan ..... 1-119867[U]

[51] Int. Cl.[5] ..... A63H 33/00

[52] U.S. Cl. ..... 446/14; 446/385; 428/913; 106/21

[58] Field of Search ..... 446/14, 385; 428/913, 428/29; 427/148; 106/21

[56] References Cited

U.S. PATENT DOCUMENTS

| | | | |
|---|---|---|---|
| 1,592,148 | 7/1926 | Munn . | |
| 4,028,118 | 6/1977 | Nakasuji et al. | 106/21 |
| 4,176,273 | 11/1979 | Fujie | 219/220 |
| 4,554,565 | 11/1985 | Kito et al. | 428/913 X |
| 4,720,301 | 1/1988 | Kito et al. | 106/21 |
| 4,725,462 | 2/1988 | Kimura | 428/29 |
| 4,818,215 | 4/1989 | Taga | 431/126 |
| 4,820,683 | 4/1989 | Vervacke et al. | 503/210 |
| 4,895,827 | 1/1990 | Vervacke et al. | 503/210 |
| 4,917,643 | 4/1990 | Hippely | 446/14 |
| 4,920,991 | 5/1990 | Shibahashi et al. | 132/73 |

FOREIGN PATENT DOCUMENTS

| | | | |
|---|---|---|---|
| 2205255 | 12/1988 | United Kingdom | 446/14 |

*Primary Examiner*—Mickey Yu

*Attorney, Agent, or Firm*—Fitzpatrick, Cella, Harper & Scinto

[57] ABSTRACT

An toy set having at least one section which bears a color memory dye of an electron-supplying organic coloring compound, an electron accepting compound and an ester. The color memory dye assumes a first color below t1 (°C.) and a second color above t2 (°C.), wherein $t2>t1$, $0 \leqq t1$, $t2 \leqq 50°$ C. and $5 \leqq t2-t1 \leqq 35$. Both the first and second colors can be displayed between t1 and t2. For the purpose of determining the proper temperature range for a color characteristic, temperature-sensitive visual indicators are provided.

32 Claims, 2 Drawing Sheets

TOY THAT STABLY EXHIBITS DIFFERENT COLORS WITH INDICATOR FOR PROPER TEMPERATURE APPLICATION

BACKGROUND OF THE INVENTION

1. Field of the Invention

This invention relates to a toy set and in particular, to a toy set which can arbitrarily assume a particular color display. The toy set of the present invention can stably display one color or several colors, and then change the one or several color, to another color or colors which can also be stably displayed. A display state in which plural colors corresponding to each particular color or colors stably coexist can also be selected. Temperature-sensitive indicator(s) comprising means for developing one or more color display states are provided.

2. Brief Description of the Prior Art

There have previously been proposals relating to toys which exhibit color change in response to a temperature change in, for example, Japanese Utility Model Publication No. 12864/89. Such conventional toys change their color at a predetermined temperature from one color state existing at a normal temperature range to another color state existing outside (i.e., either above or below) that temperature range. However, when the heat (or chill) which is required to obtain the other color state is discontinued and the toy cools (or warms), the toy returns from the other color state to the first color state which appears in the normal temperature range. Thus, the prior art toys merely provide enjoyable but temporary color change corresponding to the environmental, or local temperature surrounding the toys.

Accordingly, it would be desirable to produce a toy which can attain another color which retains stability after the temperature of the toy has returned to normal and the heat or chill is removed. It would also be desirable to produce a toy which can stably exhibit two or more colors simultaneously when the temperature of the toy has returned to normal after the heat or chill is removed.

BRIEF DESCRIPTION OF THE PRESENT INVENTION

It is an object of the present invention to provide toys which can change from one stable color state to another.

It is another object of the present invention to provide toys which can simultaneously exhibit at least two colors, at least one of which is changeable such that it is stably maintained both before and after changing.

It is another object of the present invention to provide visual indicating means for developing each of the desired color display states. These objects and others are provided by the present invention which is a novel toy having at least one color which can be changed upon the application of heat or chill. For each of the one or several possible colors, each toy can have any arbitrarily selected color state for a particular color both before and after the color has been changed. Additionally, since in the present invention both the color before color changing and the color after the color changing may simultaneously exist for each particular color, the toy can be made to exhibit various appearances within predetermined temperature ranges through the use of the visual indicator for determining the proper temperature for a given color such that the commercial desirability of the toy set is enhanced.

BRIEF DESCRIPTION OF THE DRAWINGS

FIG. 3 shows the state of the reversible thermochromatic layer; FIG. 4 shows a proper treatment indicator which appears in response to the proper treatment temperature range.

FIGS. 5 and 6 show an improper treatment indicator which appears in response to improper treatment temperature range.

DETAILED DESCRIPTION OF THE PRESENT INVENTION

Figure 1:
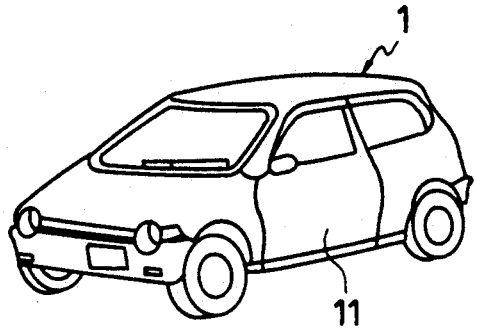
FIGS. 1 and 2 are perspective views of one preferred embodiment of the color memory toy set of the present invention. These figures show the state of the toy before and after the change in appearance due to the color change, respectively.
Figure 2:
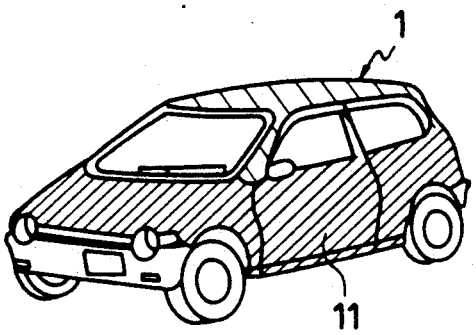

The present invention is described with reference to FIGS. 1 to 7 in which a toy car is specifically utilized for purposes of explanation. It will be appreciated, of course, that any other desired toy shape can be utilized as part of a toy.

In the color memory toy car set according to the present invention, at least part of a surface of the toy car set is colored with a coloring material containing a color memory dye. The color memory dye reversibly changes color and exhibits a large hysteresis characteristic in response to a temperature change. The color memory dye comprises an electron-supplying organic coloring compound, an electron-accepting compound and an ester compound for causing the hysteresis characteristic.

The temperature sensitive indicator 2 of figures 3, 4, 5 and 6 serves to provide a visual recognition of the proper treatment temperature for a given color state.

Preferable electron-supplying organic coloring compounds are diaryl phthalides, indolyl phthalides, polyaryl carbinols, leuco auramines, acyl auramines, aryl auramines, rhodamine B lactams, indolines, spiropyrans and fluorans.

Preferable electron-accepting compounds are phenolic compounds, metal salts of the phenolic compounds, aromatic carboxylic acids, aliphatic carboxylic acids, metal salts of the acidic phosphoric esters, metal salts of the acidic phosphoric esters and triazole compounds.

Preferable ester compounds are alkyl esters, aryl esters and cycloalkyl esters of aromatic carboxylic acid having substitent(s) or not in the aromatic ring, branched alkyl esters, aryl esters, aryl alkyl esters and cycloalkyl esters of aliphatic carboxylic acid, alkyl esters of alicyclic carboxylic acid, diestels of dicarboxylic acid and glycerides.

The color memory dyes disclosed in U.S. Pat. No. 4,720,301 can be suitably used in the present invention. In this regard, British Patent Application Publication No. 2,205,255 and copending U.S. patent application Ser. No. 476,941 (filed Feb. 8, 1990) all relate to a toy using the color memory dyes. As used in this invention, the color memory dyes preferably provide a lower color-changing temperature t1 (°C.) and a higher color-changing temperature t2 (°C.) such that t2>t1, wherein the color memory dye displays a different color above t2 as compared to below t1. Also, as used in this invention, one of the color states below t1 or above t2 may be transparent for each or any of the particular colors applied. Color-changing temperatures t1 and t2 are selected to both be within the temperature range of 0° C. to 50° C., wherein $5 \leqq t2-t1 \leqq 35$.

Thus, applying a chill of less than t1 (°C.) (or a warming of more than t2 (°C.)), a different color state for each particular color can be attained if the previous color state was provided by a warming of more than t2 (°C.) (or a chill of less than t1 (°C.)). A state of coexistence of both colors can also be selected if the color changing portion of a toy car is locally chilled or warmed. The thus selected color display state can be maintained stably within the temperature range of t1 to t2. Preferably, the lower color-changing temperature t1 (°C.) satisfies the requirement of $5 \leqq t1 \leqq 23$, and the higher color-changing temperature t2 (°C.) satisfies the requirement of $25 \leqq t2 \leqq 40$.

Figure 7:
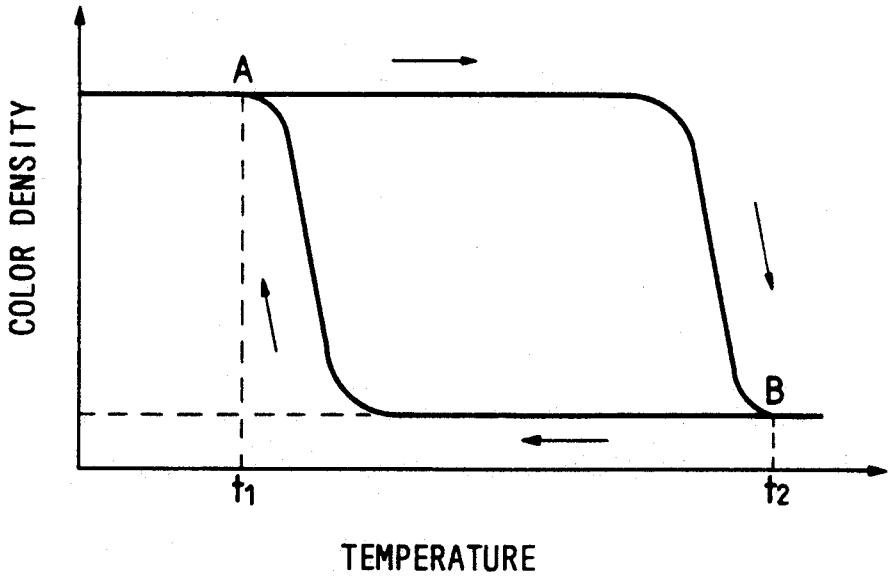
FIG. 7 is a graph which defines the hysteresis characteristics (color changing characteristics) of the color memory dye used in the present invention.
Figure 3:
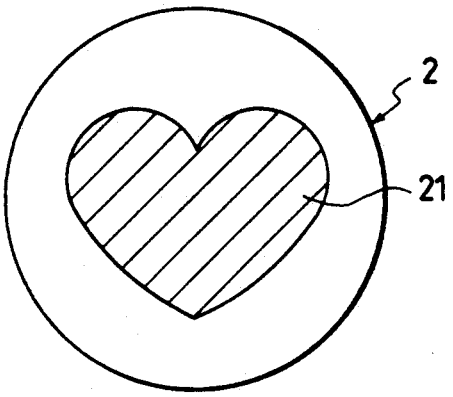
FIG. 3, 4, 5, and 6 depict the temperature-sensitive indicators. They show the state before and after the color changing.
Figure 4:
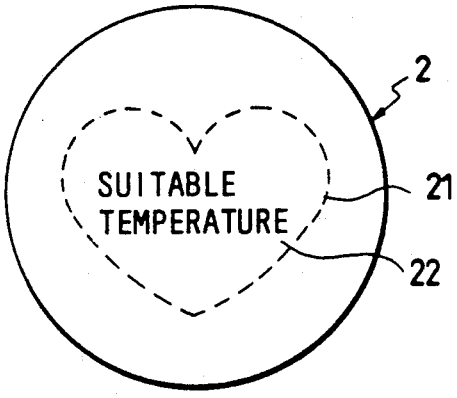
Figure 5:
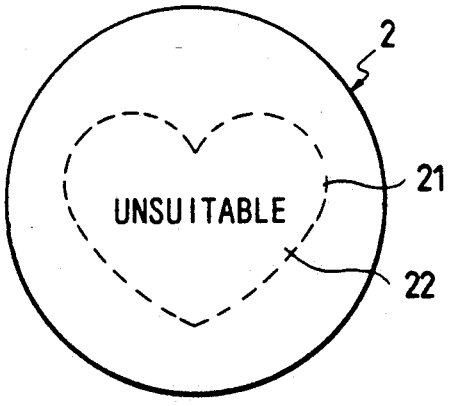
Figure 6:
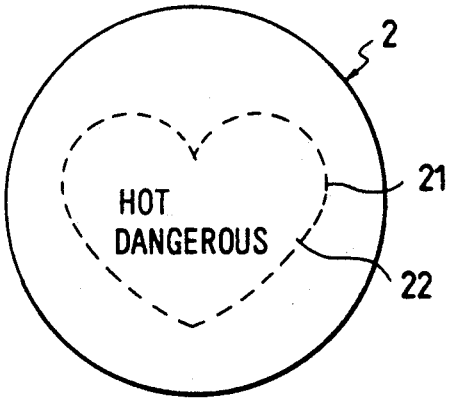

The hysteresis characteristic of the present invention is obtained from the shape of a curve obtained by plotting changes in color density according to changes in temperature. As shown in FIG. 7, in the present invention the curve obtained when the temperature increases from below t1 to above t2 differs from the curve obtained when it decreases from above t2 to below t1 so that a loop is formed when the two curves are combined. As used in the present invention, the temperature at point A (where the two curves join at the lower temperature side) is defined as t1 (°C.), i.e., the lower color-changing temperature and the temperature at point B (where the two curves join at the higher temperature side) is defined as t2 (°C.), i.e., the higher color-changing temperature.

Temperature t1 of the color memory dye can be attained, for example, from cold spray, the temperature within a refrigerator, cold water, ice, etc., and temperature t2 can be attained, for example, from a hair dryer, human body temperature, warm water and the like. Thus, since these temperatures are readily obtained throughout the human environment, attaining the necessary chilling and beating temperatures can easily be obtained.

The temperature range between t1 and t2 defines the dual-color maintaining temperature range in which both color states coexist stably. The present invention may also utilize plural color memory dyes with different hysteresis characteristics. Application of these dyes on the same or different surfaces of a toy can reversibly provide a wide variety of patterns and designs. Preferably, in this instance, the hysteresis characteristic (i.e., t1 to t2 range) of one of the color memory dyes completely includes that of the other color memory dye (i.e., t1' to t2'), that is, it is desirable that t1<t1' and t2>t2', However, if one of the dyes assumes a colorless state, it is also acceptable if one of t1 or t2 (or t1' or t2') is within the range t1' to t2' (or t1 to t2).

In a system in which a color layer 11 of the color memory toy car is colored with the color material containing not less than two kinds of reversible color memory dyes having respective different color changing temperature ranges (t1 to t2), the reversible thermochromatic layer 21 of the indicator is changeable in a temperature range between two adjacent lower color-changing temperatures t1 or in a temperature range between two adjacent higher color-changing temperatures t2. The color is reflectively caused to appear and disappear to produce a desired appearance.

The color memory dye may be dispersed in a medium containing a binder, and can be provided in the form of a coloring material such as ink, pigment or paint, so that the toy surfaces or any desired portion of such surfaces (1 or 11) can be treated with the color memory dye by any suitable conventional method such as coating, spraying, printing and dipping. Generally, the surface is treated before the toy set is assembled. Alternatively, certain portions of the toy set may be colored after the toy set is assembled.

Of course, colors, patterns and the like may also be formed on the surface of a toy set using conventional color materials or pigments before or after the color treatment of the present invention, thereby providing a wide variety of possible appearances due to color changes.

The binder may be a conventionally-used binding agent such as natural or synthetic rubbers and waxes. The kind of the binder to be used is suitably selected depending on the material of the toy set.

In order to enhance the sensitivity and effectiveness of the color memory dye, it is desirable that the dye be placed within microcapsules having a particle size of from 0.5 to 50 μm, and more preferably from 1 to 30 μm, to form a microencapsulated pigment. The microencapsulated pigment preferably contains from 0.1 to 40 wt. % (preferably, from 0.2 to 25 wt. %) of the color memory dye and is fixed to the binder in a dispersed condition to form a color layer. Preferably, the content of the microencapsulated pigment in the color layer is from 5 to 80 wt. % (more preferably, from 10 to 60 wt. %) to obtain optional thermochromatic effects. Namely, if the content is less than 5 wt. %, the color density is so low that the change of color is not clearly seen. On the other hand, if the content exceeds 80 wt. %, a clear colorless state is difficult to attain. Similarly, the thickness of the color layer should be at least 0.5 μm, preferably from 1 to 400 μm, and more preferably 10 to 200μ, so that satisfactory color change effects can be obtained within the above pigment content ranges. If the thickness is less than 0.5 μm, a clear color change is not obtained, while if the thickness exceeds 400 μm, the beauty of the appearance is damaged.

In a system in which the member is made of a thermoplastic plastics material, the toy may be made by melting and molding the material mixed with the microcapsule pigment of 0.1 to 40 wt. % (preferably 0.2 to 25 wt. %) in which the color memory dye is included.

The temperature-sensitive indictor 2 can be directly printed onto a sheet of paper, film a plate, a bar, of other substrate of a suitable shape. The indicator may be directly printed onto a bottom or a side wall of a liquids container. The indicator may also be directly printed onto a heating or a cooling marker in which warm water or cold water or other heating or cooling medium is filled.

In the system using the above sheet material, the indicator may be attached to or wound on a heating or a cooling instrument through a sticky agent or an adhesive agent.

Examples of the reversible thermochromatic layer 21 include a conventional reversible thermochromatic material comprising three components, an electron-supplying coloring organic compound, a developer for this compound, and a color changing-temperature adjusting material for determining the temperature of color-changing reaction of the above two components. It may also comprise thermochromatic pigment in the form of particles of a resin solid solution of the above composition. A suitable example is thermochromatic materials disclosed U.S. Pat. No. 4,028,118, British Patent No. 1,405,701 earlier proposed by the present applicant.

The above material can be in the form of ink or paint to form a thermochromatic layer on the substrate. In a system in which the substrate is made of a thermoplastic resin, the above material can be blended into the resin to form a sheet or the like, thus forming an integrally-incorporated thermochromatic layer.

The thermochromatic layer 21 may be merely a solid painting, or an image of a pattern, a character or a sign. Also, this layer is not limited to single layer construction and may advantageously be comprised of a multilayer construction.

The indicator 22 indicates the proper treatment temperature or the appearance developing after the color changing. The examples, a character, sign, figure, or pattern may be formed by ordinary printing ink or with the above-mentioned reversible thermochromatic ink.

In order to enhance the glossiness, stain resistance and water resistance etc. of the present invention, a transparent resin film of an acrylic, a water-repellent or other transparent resin may be formed on the colored surface of the toy car. Also, an ultraviolet-absorbing agent may be mixed in such resin to improve its resistance to fading in light.

When the color-changing portions of the toy car are formed of a thermoplastic material, the color memory dye may be kneaded in the material before the molding, so that the toy car can be molded of a molten material. Preferably, in this instance the pigment is microencapsulated. Such blending can also be suitably used in combination with another color memory dye system using, for example, the above-mentioned coating means.

When a portion of the toy colored with the color memory dye which displays a single color state is cooled to below the temperature t1, the other color state is attained, if the first color state resulted from that portion being warmed above t2. The cooled portion can now be warmed to attain the normal temperature range of from t1 to t2, stably maintaining the other color state.

The surface of the portion in the other color state can now be brought into the first color state by heating that portion above the temperature t2. That portion can be maintained in the first color state simply by being returned to the normal temperature range. However, if the first color state resulted from being cooled below t1, the other color state is, of course, attained be warming that portion above t2. All the above changes can, of course, be reversed, as desired. Similarly, as stated above, the color states may overlap with color states of a second color memory dye, and at least one of the color states may be clear.

The reversible thermochromatic layer of the temperature-sensitive indicator changes color upon application of heat or chill. This color change allows a character or a pattern to be visualized, thereby providing a visual means for recognition of the proper treatment temperature. Also, the reversible thermochromatic layer provides an indication of improper temperature or an improper temperature range.

In the system in which the color layer of the toy contains not less than two kinds of reversible color memory dyes, each processing different color-changing temperature (t1 to t2), the reversible thermochromatic layer of the indicator changes in the temperature range between the adjacent lower color-changing temperatures t1 or in the temperature range between two adjacent higher color-changing temperatures t2. Therefore, the desired dye can be selectively changed in color to produce the desired appearance without causing any influence on the other color-changing temperature range.

Thus, according to the toy set of the present invention, a user can readily select and maintain any desired one of at least two kinds of appearances. Moreover, by applying heat or chill, as desired, to only a part of the colored portion, only the appearance of that part is changed. Further, if the various portions of the surface are colored respectively with coloring materials having different kinds of color memory dyes, the overall pattern is changed each time each portion is changed. All these above-mentioned changes are temperature controlled with reversible thermochromatic layer of the temperature sensitive visual indicator.

The present invention is now described in further detail in the following actual embodiments.

EXAMPLE 1

A polyvinyl chloride doll was chosen for this example. The doll's lips, cheeks and eyelids, to simulate ordinary make-up, were colored with light pink, light cinnabar and light purple respectively. Spray coating materials embodying the reversible color memory dyes of the present invention were sprayed onto the doll's lips, cheeks and eyelids. These applied color memory dyes respond to temperature change between blue and a colorless state (t1: 10° C.; t2: 32° C.) and between pink and a colorless state (t1: 10° C.; t2: 32° C.). The finished product is a color memory doll wearing psychedelic facial makeup and able to exhibit two color aspects.

Temperature-sensitive indicators were prepared in the following manner.

An indicator for determining the state of the ordinary makeup condition (Indicator A) was printed on a surface (obverse) of a white opaque sheet of polyvinyl chloride (whose reverse surface was coated with a pressure-sensitive adhesive). "Proper temperature" was printed on its surface with ordinary light blue printing ink. Then, a design of a heart was superimposed on this printing with a reversible thermochromatic ink. The thermochromatic ink assumes a pink color below 35° C. and changes to a colorless state above 35° C. Another indicator for determining the state (indicator B) was printed using the word "improper" on another portion of the above sheet with ordinary light green printing ink. Then, the phrase "proper temperature" was printed in superposed relation to the above character "improper" with reversible thermochromatic ink assuming deep blue below 8° C. and a colorless state above 8° C. Then, that portion of the sheet was cut into a suitable size to prepare an indicator B.

The above indicators A and B were bonded to bottoms of two cups (called cup A and cup B respectively) of a polypropylene resin, respectively. Then, warm water was poured into cup A, and cold water was poured into cup B, the hot and cold media. Using a sponge tipped writing instrument attached through the end of a barrel or holder and soaked with the above warm or cold water, variation of hot and cold temperature was applied to the doll's coated features. The appearance changed from the psychedelic makeup condition to the ordinary makeup condition upon application of the warm water. The warmth caused the pink heart design of indicator A to disappear and caused the characters "proper temperature" to appear. This appearance was maintained in the normal temperature range.

The above procedure was applied providing a cold temperature medium (cold water application). Upon application, the face exhibiting the ordinary makeup condition in the normal temperature range did not change in color in the temperature range in which the character "improper" was visible. However, the face exhibiting the ordinary makeup condition was changed to the psychedelic appearance in the temperature range in which the characters "proper temperature" appeared. This appearance was maintained in the normal temperature range.

The above reversible changes of appearance were repeatedly reproduced in the proper temperature ranges by means of the color changing of indicators A and B representing such color changing.

EXAMPLE 2

In this example, the phrase "hot danger" was printed on a surface of a white opaque polyvinyl chloride sheet with ordinary light red printing ink. The phrase "proper temperature" was then printed in superposed relation to "hot danger" using reversible thermochromatic ink. The thermochromatic ink assumes pink below 45° C. and changes to a colorless state above 45° C. The design of a heart concealing the above characters was then printed with reversible thermochromatic ink assuming pink below 35° C. and changing to a colorless state above 35° C., thereby preparing an indicator C.

When warmth was applied, (using the cold/warm water application system described in example 1), the face of the doll changed from the psychedelic makeup condition to the ordinary makeup condition. Indicator C was bonded to the bottom of the water application cup in this case instead of the indicator B. The pink heart design of indicator C, displayed in the normal condition, disappeared upon application of the warm water. The printed phrase "proper temperature" then appeared in the proper temperature range. Warm water applied to the doll's face changed the psychedelic makeup appearance to the desired ordinary makeup appearance. Also, the phrase "proper temperature" printed in pink ink on indicator C disappeared, and the phrase "hot danger" appeared.

EXAMPLE 3

In this example, an experiment is performed similar in substance to example 1 except that the color memory dyes are applied to a soft sheet of opaque polyvinyl chloride instead of the polyvinyl chloride doll. Such color memory dyes are applied in the same differing colors (with the same hysteresis characteristics) as would be in example one.

Indicators A, B, and C as defined in example 1, were used. A plurality of sheets having other appearance printed in a similar way were bound together by fusion to obtain a book for testing.

The same hot/cold applications procedure was performed as in examples 1 and 2. The indicators A, B and C were attached to the hot/cold water cups as described. In each picture, when the proper medium for producing the appearance of the phrase "proper temperature" was applied, the desired appearance was produced.

EXAMPLE 4

As in example 1, a polyvinyl chloride doll with lips, cheeks and eyelids, made up with ordinary makeup colors of light pink, light cinnabar and light purple respectively, was used. The coating material applied to these facial features contained the color memory dyes reversible between pink (deeper in tone than the above pink) and a colorless state (t1: 22° C.; t2: 32° C.), between cinnabar (deeper than the above cinnabar) and a colorless state (t1: 22° C.; t2: 32° C.) and between purple (deeper than the above purple) and a colorless state (t1: 22° C.; t2: 32° C.).

After the coating material described above was applied, coating material was applied containing color memory dyes reversible between pink (further deeper in tone) and a colorless state (t1: 14° C.; t2: 32° C.), between cinnabar (further deeper) and a colorless state (t1: 14° C.; t2: 32° C.) respectively on the corresponding portions in a superposed manner. This in effect produced a color memory doll with color reversible between the three makeup appearances, that is, the ordinary makeup appearances, the slightly heavy makeup appearance and the heavy makeup appearance.

An indicator D was prepared to allow determination of the temperature range for the ordinary makeup appearance. It was prepared by bonding a sheet-like indicator C (as described above but cut into a circular shape about 4 cm in diameter) to a disk-shaped plate of polyvinyl chloride resin having a diameter of about 5 cm.

An indicator E was prepared to allow determination of the temperature range for the light makeup appearance. It was prepared as follows. Characters "too high" were printed on the surface of a white opaque sheet of polyvinyl chloride with ordinary light pink ink. Then, phrases "light makeup" and "proper temperature" were printed on it with reversible thermochromatic ink assuming pink below 19° C. and changing to a colorless state above 19° C. A heart design concealing the phrases "too high" and "proper temperature" was then printed with thermochromatic ink assuming pink below 14° C. The sheet was cut as described above and bonded to a disk-shaped plate of polyvinyl chloride resin.

An indicator F was prepared to allow determination of the temperature of the heavy makeup appearance. It was prepared according to the same procedure which produced indicator E except that the phrase "proper temperature" was printed with thermochromatic ink assuming pink below 10° C. and changing to a colorless state above 10° C.

Warm and cold water was applied to the polyvinyl chloride doll as in the application procedure described above. Indicator D was dipped in the warm water cup used in such application procedure. Indicators E and F were dipped in the cold water cup in like manner. The indicators properly performed their function of producing the desired appearance in the temperature range in which the characters "proper temperature" was visible. The appearance of the doll's face corresponded to the required color response for each temperature range, as defined by the indicators.

EXAMPLE 5

In this example, the polyvinyl chloride doll, possessing the facial characteristics defined in example 4 was further coated with cheek rouge comprising a reversible color memory dye. In response to temperature, the color memory dye changed between pink and a colorless state (t1: 8° C.; t2: 32° C.).

A thermochromatic indicator G was prepared according to the procedure of example 4. It contained the phrase "proper temperature" printed with thermochromatic ink displaying color below 5° C. and becoming colorless above 5° C. A thermochromatic indicator F was prepared using color memory dye becoming pink below 8° C. as above. It was prepared in the design of a heart in order to conceal the phrase "proper temperature", which became pink below 13° C.

In a similar manner, an indicator H was prepared. It contained the phrase "proper temperature" printed with reversible thermochromatic ink becoming colored below 14° C. and becoming colorless above 14° C. The phrase was covered by a heart formed with reversible thermochromatic ink becoming pink below 8° C. and becoming colorless above 8° C.

Warm and cold water was then applied to the dill and the indicators D, E, F and G as in Example 4. In the specified temperature range which caused the indicators to display the phrase "proper temperature", the ordinary makeup appearance, the heavy makeup appearance and the appearance with the cheek rouge were selectively produced and visible. All temperature range operation was successful.

EXAMPLE 6

A miniature car with a metallic surface was coated with a coating material containing color memory dyes. These dyes were reversible between pink and a colorless state (t1: 20° C.; t2: 40° C.) and between blue and colorless state (t1: 14° C., t2: 32° C.). They were blended with ordinary yellow ink. Colored in this manner, the memory miniature car exhibited a color reversibility between deep purple, red and yellow.

Thermochromatic indicators were prepared in the following manner.

An indicator H, used to produce the yellow appearance was prepared with the phrase "proper temperature" printed on the surface of a white opaque sheet of polyvinyl chloride using ordinary light blue printing ink. Then, a star was superimposed upon the phrase with reversible thermochromatic ink the color of deep blue below 45° C. and colorless above 45° C.

An indicator I was used to indicate the appropriate temperature range for the red appearance (from deep purple to red). In a manner similar to that described above, the phrase "proper temperature" was formed with reversible thermochromatic ink assuming blue below 40° C. and changing to a colorless state above 40° C. The phrase "too high" was then printed in a superposed manner with ordinary light blue ink. As above, a star formed with thermochromatic ink assuming deep blue below 32° C. and changing to a colorless state above 32° C. was then formed to conceal both the above phrases.

An indicator J was used to indicate the appropriate temperature for producing the other red appearance (from yellow to red). The phrase "too high" was printed with ordinary blue ink and the phrase "proper temperature" was printed with reversible thermochromatic ink which changed from a colorless state to blue blow 19° C. A star formed with reversible thermochromatic ink assuming deep blue below 14° C. and changing to a colorless state above 14° C. was superimposed on these phrases concealing them.

An indicator K was used to indicate the appropriate temperature for producing the deep purple appearance. The phrase "proper temperature" was formed with reversible thermochromatic ink assuming light blue below 10° C. and changing to a colorless state above 10° C., forming this indicator.

Each of the above indicators H, I, J and K were insert-molded in the bottom of a polystyrol resin container. Warm water or cold water was poured into the container in order to test these "proper temperature" indicators. In each application of a hot or cold medium, the desired appearance was produced in each of these visual indicators.

As described in the above example embodying the present invention, the user can change the color by application of suitable heat or cold. The visual indicators allow for the user to apply the correct amount of hot or cold for the particular color display in a particular color range. Combined with the visual indicators the applied color material allows the user to change a toys' appearance, return it to its appearance before the color changing or the appearance after the color changing. Also, the appearance of both colors can be selected and maintained in the normal temperature range.

In such a set arrangement, there are no risks such as the failure to produce the desired color change because of an improper treatment temperature, excessive cooling below the lower color-changing temperature, or excessive heating above the higher color-changing temperature.

Thus, the desired appearance is positively produced by the proper treatment temperature. Even toys in which a variety of color patterns are available (through a combination of color memory dyes) the toy, s colors may be selectively changed to the desired appearance. The toy set clearly makes full use of the characteristics of the color memory dye, and the user can enjoy in a wide variety of color changes with the single toy.

What is claimed is:

1. A toy at least one section thereof bearing a color memory dye comprising an electron-supplying organic coloring compound, an electron accepting compound and an ester;

said color memory dye assuming a first color below t1 (°C.) and a second color above t2 (°C.), wherein $t2>t1$, $0\leqq t1$, $t2\leqq 50°$ C. and $5\leqq t2-t1\leqq 35$, both of said first and second colors capable of being displayed between t1 and t2; and a temperature sensitive visual indicator, said temperature sensitive visual indicator being visible when at least one of said first and second colors is displayed and said temperature sensitive visual indicator operating to communicate written or pictoral information, said written or pictoral information conveying how to display the other of said first or second colors.

2. The toy of claim 1, wherein $5\leqq t1\leqq 23$.

3. The toy of claims 1 or 2, wherein $24\leqq t2\leqq 40$.

4. The toy of claim 3, wherein the color memory dye is dispersed in a binder medium.

5. The toy of claim 4, wherein the dispersed color memory dye is microencapsulated.

6. The toy of claim 5, wherein the color memory dye microcapsules have a particle size of from 0.5 to 50 μm.

7. The toy of claim 6, wherein the color memory dye microcapsules contain from 0.1 to 40 weight % color memory dye.

8. The toy of claim 7, wherein the color memory dye microcapsules have a particle size of from 1 to 30 μm.

9. The toy of claim 8, wherein the color memory dye microcapsules contain from 0.2 to 25 weight % color memory dye.

10. The toy of claim 4, wherein the color memory dye is dispersed in the binder at from 5 to 80 weight %.

11. The toy of claim 5, wherein the color memory dye is dispersed in the binder at from 10 to 60 weight %.

12. The toy of claim 4, wherein said section of toy bearing said color memory dye is coated with a color memory dye layer of at least 0.5 μm thickness.

13. The toy of claim 12, wherein said section of toy bearing said color memory dye is coated with a color memory dye layer of from 1 to 400 μm thickness.

14. The toy of claim 13, wherein said section of toy bearing said color memory dye is coated with a color memory dye layer of from 10 to 200 μm thickness.

15. The toy of claim 3, wherein said section of toy bearing said color memory dye is a thermoplastic material and a pigment is admixed into thermoplastic material.

16. The toy of claim 15, wherein said color memory dye is microencapsulated.

17. The toy of claim 16, wherein one of said first and second colors is clear.

18. The toy of claim 3, wherein said toy comprises a second color memory dye which assumes third and fourth colors.

19. The toy of claim 18, wherein one of said first, second, third or fourth colors is clear.

20. The toy of claim 4, wherein the binder medium is a thermoplastic plastics material.

21. The toy of claim 20, wherein the toy was make by melting and molding the material mixed with microencapsulated color memory dye.

22. The toy of claim 21, wherein the color memory dye microcapsules have a particle size of from 0.5 to 50 μm.

23. The toy of claim 1, wherein said temperature sensitive indicator includes a reversible thermochromatic layer.

24. The toy of claim 23, wherein said reversible thermochromatic layer comprises a reversible thermochromatic material.

25. The toy of claim 24, wherein said reversible thermochromatic material comprises a second color memory dye.

26. The toy of claim 25, wherein said second color memory dye comprises an electron-supplying coloring organic compound, a developer for this compound, and a color changing-temperature adjusting material for determining the temperature of color-changing reaction of the above two components.

27. The toy of claim 25, wherein said second color memory dye assumes a first color below t1 (°C.) and a second color above t2 (°C.), wherein $t2>t1$, and $5 \leqq t2-t1 \leqq 35$, both of said first and second colors capable of being displayed between t1 and t2.

28. The toy of claim 25, wherein said reversible thermochromatic material comprises a reversible thermochromatic pigment in the form of a resin solid solution.

29. The toy of claim 25, wherein said reversible thermochromatic material is an ink or paint.

30. The toy of claims 28 or 29, wherein said reversible thermochromatic material forms a thermochromatic layer on a substrate.

31. The toy of claim 30, wherein said substrate is made of thermoplastic resin.

32. The toy of claim 30, wherein said thermochromatic layer comprises a sheet.

* * * * *

UNITED STATES PATENT AND TRADEMARK OFFICE

CERTIFICATE OF CORRECTION

PATENT NO. : 5,085,607

DATED : February 4, 1992

INVENTOR(S) : Yutaka Shibahashi, et. al.

It is certified that error appears in the above-identified patent and that said Letters Patent is hereby corrected as shown below:

On the Title page, item [57] Abstract,

Line 1, "An" should read --A--.

COLUMN 2

Line 56, "substitent(s)" should read --substituent(s)--.

COLUMN 3

Line 44, "beating" should read --heating--.
Line 57, "t2>t2′," should read --t2>t2′.--.

COLUMN 4

Line 52, "film" should read --film,--.

COLUMN 10

Line 35, "toy,s" should read --toy's--.
Line 38, "in" should be deleted.

UNITED STATES PATENT AND TRADEMARK OFFICE

CERTIFICATE OF CORRECTION

PATENT NO. :5,085,607

DATED :February 4, 1992

INVENTOR(S) :Yutaka Shibahashi, et. al.

It is certified that error appears in the above-identified patent and that said Letters Patent is hereby corrected as shown below:

COLUMN 11

Line 21, "into" should read --into said--.
Line 34, "was make" should read --was made--.

Signed and Sealed this

Thirtieth Day of November, 1993

*Attest:*

*Attesting Officer*

BRUCE LEHMAN

*Commissioner of Patents and Trademarks*